United States Patent [19]

Katada et al.

[11] Patent Number: 4,817,521

[45] Date of Patent: Apr. 4, 1989

[54] COMPRESSION APPARATUS FOR SOLID WASTE

[75] Inventors: Katsuo Katada, Kamakura; Yoshiyuki Sakata, Yokohama, both of Japan

[73] Assignee: Ishikawajima-Harima Heavy Industries Co., Ltd., Tokyo, Japan

[21] Appl. No.: 19,335

[22] Filed: Feb. 26, 1987

[30] Foreign Application Priority Data

| | | | |
|---|---|---|---|
| Feb. 27, 1986 | [JP] | Japan | 61-42317 |
| Mar. 6, 1986 | [JP] | Japan | 61-48796 |
| Jul. 9, 1986 | [JP] | Japan | 61-161561 |
| Jul. 21, 1986 | [JP] | Japan | 61-171054 |
| Sep. 17, 1986 | [JP] | Japan | 61-218501 |
| Dec. 25, 1986 | [JP] | Japan | 61-313538 |

[51] Int. Cl.[4] ..... B30B 5/00; G21F 9/12; G21F 9/24; G21F 9/00

[52] U.S. Cl. ..... 100/240; 100/245; 100/229 A; 100/902; 141/73; 141/80; 252/626; 252/633; 264/0.5; 422/903; 425/472

[58] Field of Search ..... 252/633; 422/903; 264/0.5; 100/42, 67, 140, 178, 179, 229 A, 230, 226, 240, 241, 242, 245, 247, 252, 902; 110/223; 141/73, 70, 80; 425/352, 406, 408, 412, 416, 422, 472

[56] References Cited

U.S. PATENT DOCUMENTS

| | | | |
|---|---|---|---|
| 691,537 | 1/1902 | Ericson | 100/241 |
| 1,488,849 | 4/1924 | Usher | 100/241 |
| 4,205,604 | 6/1980 | Ashley | 100/242 |
| 4,584,935 | 4/1986 | Luggen | 100/245 |
| 4,610,199 | 9/1986 | Pols | 252/633 |
| 4,685,391 | 8/1987 | Picker | 100/242 |

FOREIGN PATENT DOCUMENTS 60-190497 12/1985 Japan .

*Primary Examiner*—Howard J. Locker
*Attorney, Agent, or Firm*—Oblon, Fisher, Spivak, McClelland & Maier

[57] ABSTRACT

A compression apparatus for reducing solid waste in volume, including: a base; an axial compression mechanism for axially compressing a columnar container containing the solid waste, the axial compression mechanism including a punching mechanism having first teeth projecting radially outwards from an outer periphery thereof at equal angular intervals about an axis thereof, a bottom mold mechanism mounted on the base, and a drive mechanism for driving the punching mechanism toward the bottom mold mechanism for axial compression; and a mold adapted to be placed on the bottom mold mechanism to be concentric with the punching mechanism and having a cavity wall for coaxially receiving the container, the cavity wall including a plurality of mold projections projecting radially inwards therefrom and extending axially at equal angular intervals about the axis, each mold projection including an inclined inner face inclined to the axis and in contact with a conical plane tapering toward both the axis and the bottom mold mechanism, the cavity wall defining a radial compressing cavity at the inclined inner faces, adjacent two mold projections defining axial grooves therebetween for receiving expanded portions of the container during compression, the teeth of the punching mechanism being adapted to pass through respective axial grooves so that the punching mechanism passes through the radial compression cavity for compressing the container radially inwards.

11 Claims, 20 Drawing Sheets

COMPRESSION APPARATUS FOR SOLID WASTE

BACKGROUND OF THE INVENTION

1. Field of the Invention

The present invention relates to a compression apparatus for reducing the volume of solid waste by compression and particularly though not exclusively to a compression apparatus for volume reducing radioactive solid waste at a high pressure.

2. Related Art Statement

In the field of the nuclear power generation and the related fields, radioactive substances produced and solid waste contaminated with radioactive substances are subjected to a volume reduction treatment and then sealingly contained in a container for storage or transportation. In the volume reduction process, it is conventionally made to reduce the volume of a container, such as drum containing radioactive substances, by axially compressing it in a hollow cylindrical mold for preventing radioactive particulates, such as chips, from flying about. However, this prior art uniaxial compression apparatus is disadvantageous in that the circumferential wall of the drum is liable to seize upon the inner cylindrical wall of the hollow cylindrical mold when it expands radially outwards due to axial compression, and in that it is hard to reduce the volume of drums containing various kinds of solid waste so that the compressed drums have a predetermined shape and volume for placing them in new drums.

For reducing disadvantages of the above mentioned uniaxial compression apparatus, one of the inventors has proposed a triaxial compression apparatus for volume reducing solid waste in Japanese Utility Model 18-Month Publication No. 60-190,497 issued on Dec. 17, 1985, In this compression apparatus, a cylindrical waste container is compressed in one radial direction into the shape of an elliptic cylinder, then in another radial direction perpendicular to the one radial direction into a non-cylindrical shape and finally in the axial direction into a volume-reduced cylindrical shape. This triaxial compression apparatus is advantageous in that little seizure of the container is produced during compression, and in that containers, containing various kinds of solid waste, are compressed into a predetermined shape with ease. However, it is more complicated in structure than the uniaxial compression apparatus.

SUMMARY OF THE INVENTION

Accordingly, it is an object of the present invention to provide a compression apparatus for volume reducing solid waste, which apparatus is fairly simple in structure as compared to the triaxial compression apparatus, with the result in considerable reduction in equipment cost and maintenance cost.

With this and other object in view, the present invention provides a compression apparatus for reducing solid waste in volume, including: a base; an axial compression mechanism for axially compressing a columnar container containing the solid waste, the axial compression mechanism including a punching mechanism having first teeth projecting radially outwards from an outer periphery thereof at equal angular intervals about an axis thereof, a bottom mold mechanism mounted on the base, and a drive mechanism for driving the punching mechanism toward the bottom mold mechanism for axial compression; and a mold adapted to be placed on the bottom mold mechanism to be concentric with the punching mechanism and having a cavity wall for coaxially receiving the container, the cavity wall including a plurality of mold projections projecting radially inwards therefrom and extending axially at equal angular intervals about the axis, each mold projection including an inclined inner face inclined to the axis and in contact with a conical plane tapering toward both the axis and the bottom mold mechanism, the cavity wall defining a radial compressing cavity at the inclined inner faces , adjacent two mold projections defining axial grooves therebetween for receiving expanded portions of the container during compression, the teeth of the punching mechanism being adapted to pass through respective axial grooves so that the punching mechanism passes through the radial compression cavity for compressing the container radially inwards.

BRIEF DESCRIPTION OF THE DRAWINGS

The invention will now be described by way of example with reference to the accompanying drawings in which.

DETAILED DESCRIPTION OF THE PREFERRED EMBODIMENTS

Figure 1:
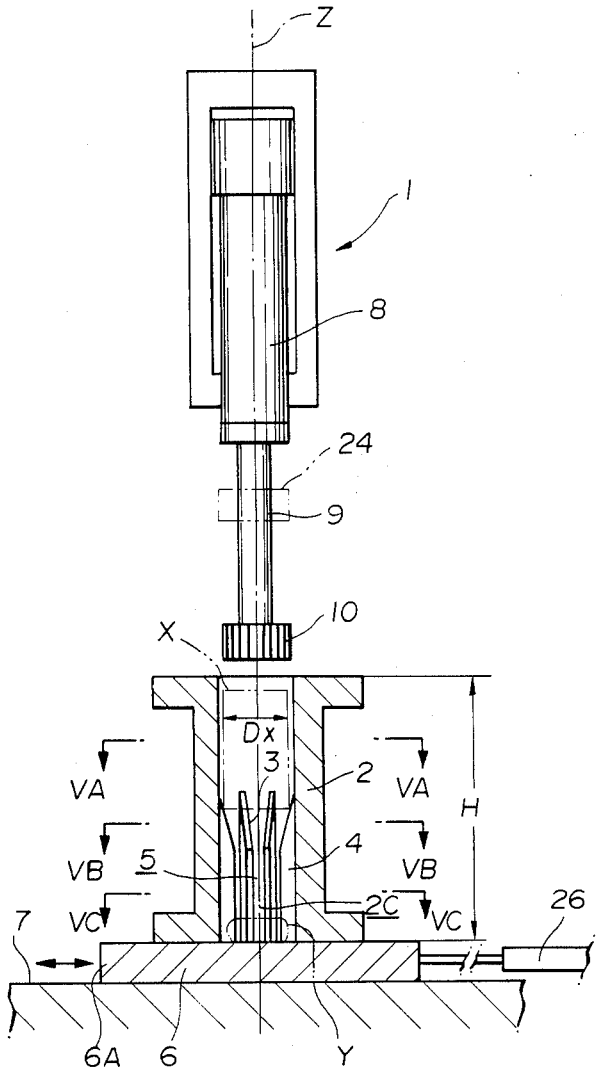
FIG. 1 is a front view, partly in section, of a volume-reduction apparatus according to the present invention.

Referring now to FIGS. 1 to 5, one embodiment of the present invention generally includes: a compression mechanism 1, a mold 2 and a bottom mold plate 6, the mold 2 mounted on the bottom mold plate 6 to be aligned to the compression mechanism 1 along an axis Z thereof. The mold 2 has a plurality of elongated mold members 4 mounted to its cylindrical inner face, two adjacent mold members 4 defining receiving recesses 5 between them. The bottom mold plate 6 is placed on a base 7.

Figure 2A:
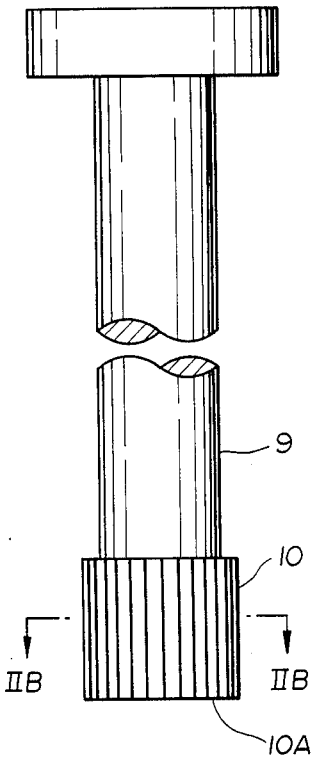
FIG. 2A is an enlarged view of the rod with the punch member in FIG. 1.
Figure 2B:
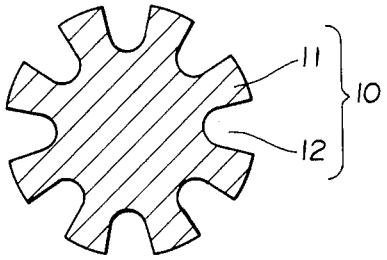
FIG. 2B is an enlarged cross-section of the punch member taken along the line IIB—IIB in FIG. 2A.
Figure 5A:
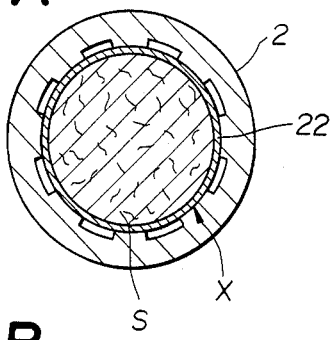
FIG. 5A is a cross-section taken along the line VA—VA in FIG. 1.
Figure 5B:
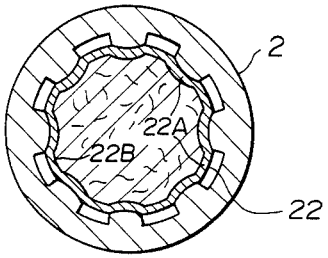
FIG. 5B is a cross-section taken along the line VB—BA in FIG. 1.
Figure 5C:
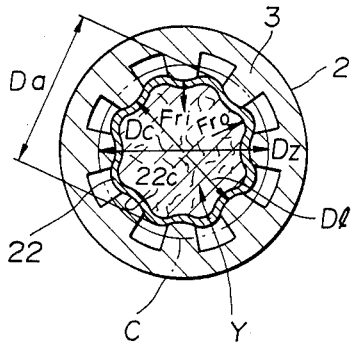
FIG. 5C is a cross-section taken along the line VC—VC in FIG. 1.

The compression mechanism 1 includes a hydraulic compression cylinder 8, of which rod 9 has a punch member 10 mounted to its distal or lower end. Both the punch member 10 and the mold 2 are made of a carbon steel. The punch member 10 is axially or vertically moved by projecting and retracting the rod 9. A steel drum X to be compressed is reduced in its height by compressing it with the punch member 10 when the rod 9 is projected, the drum X containing radioactive solid waste S to be compacted (FIGS. 5A–5C). The stroke of the punch member 10 is set to be larger than the height H of the mold 2 so that it reaches to the lower open end of the mold 2. As best shown in FIGS. 2A and 2B, the punch member 10 has a plurality of, eight in this embodiment, axial grooves 12 circumferentially formed in it at regular angular intervals about the axis thereof, thus defining a radial projections 11 between two adjacent axial grooves 12 and 12. The radial projections 11 are designed to fit into respective receiving recesses 5 with clearances to or in slidable contact with mold members 4 so that the punch member 10 is vertically or axially movable within the mold 2. The lower compacting face 10A of the punch member 10 is flat in this embodiment.

Figure 3A:
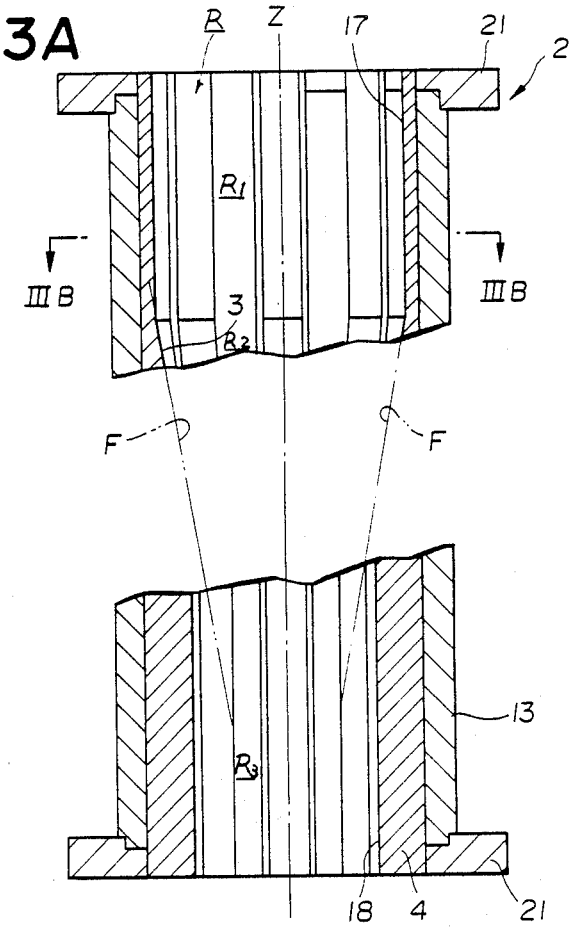
FIG. 3A is an enlarged axial section of the mold in FIG. 1.
Figure 3B:
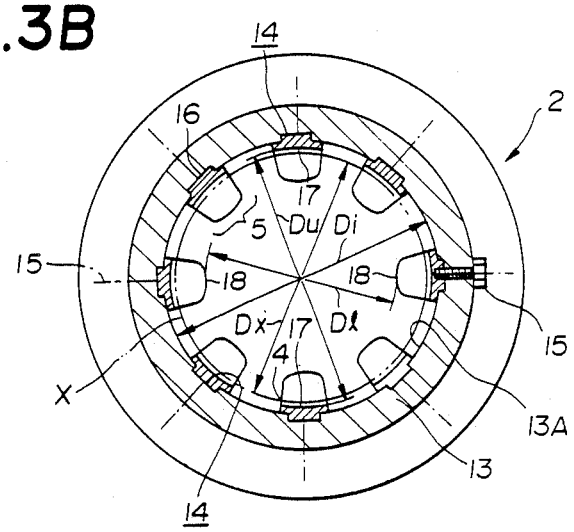
FIG. 3B is an enlarged cross-section of the mold taken along the line IIIB—IIIB in FIG. 3A.
Figure 4A:
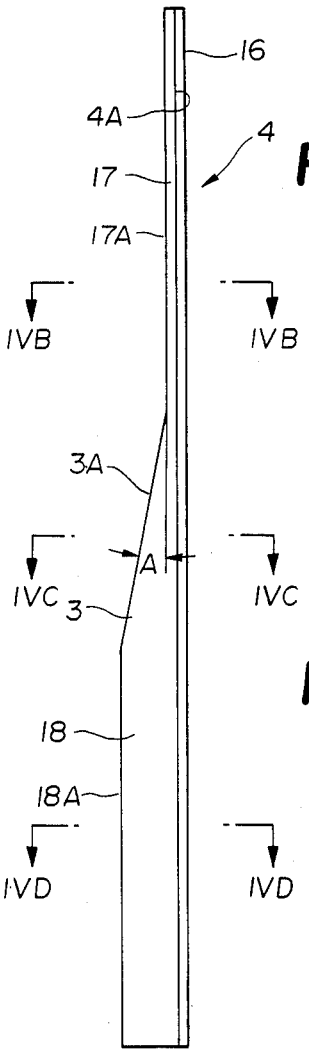
FIG. 4A is an enlarged side view of each mold member in FIG. 1.
Figure 4B:
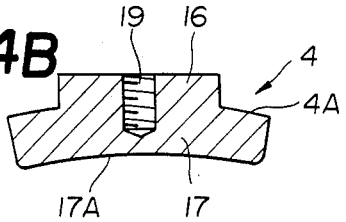
FIG. 4B is a cross-sectional view taken along the line IVB—IVB in FIG. 4B.
Figure 4D:
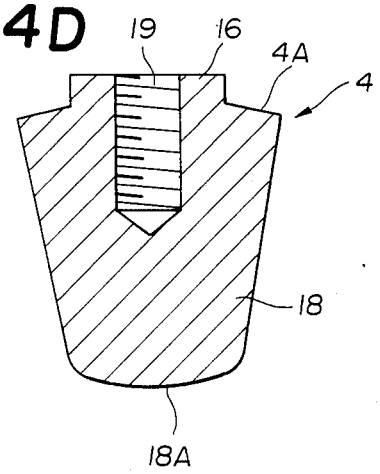
FIG. 4D is a cross-sectional view taken along the line IVD—IVD in FIG. 4D.
Figure 4C:
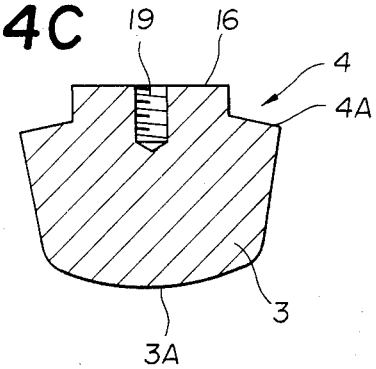
FIG. 4C is a cross-sectional view taken along the line IVC—IVC in FIG. 4B.

As clearly shown in FIGS. 3A and 3B, the mold 2 includes a hollow cylindrical body 13 and a pair of circular flanges 21 and 21 concentrically mounted opposite ends thereof. The hollow cylindrical body 13 has such an inner diameter Di that the radial projections 11 of the punch member 10 are vertically movable within it with clearances or in slidable contact with its inner face 13A. The inner diameter Di of the hollow cylindrical body 13 is 640 mm for 200 liters drum. The hollow cylindrical body 13 has a plurality of, four pairs of in this embodiment, attaching grooves 14 formed in the inner face 13A to extend axially at regular angular intervals about the axis thereof. The attaching grooves 14 are arranged in such a way that each pair of attaching grooves 14 and 14 are radially opposed to each other. Each mold member 4 is fastened to a corresponding attaching groove 14 with three bolts 15 although only one bolts 15 is shown in FIG. 3B. Thus, each pair of mold members 4 and 4 are fastened to the mold 2 to face to each other.

Each of the mold member 4 has, as shown in FIGS. 4A to 4D, an attaching ridge 16 formed to project from its rear face 4A so as to extend to its entire length. The attaching ridges 16 of the mold members 4 are fitted into respective attaching grooves 14 and are attached to the hollow cylindrical body 13 with bolts 15 threaded to threaded holes 19 formed in them. Each mold member 4 has an upper working portion 17 having the smallest thickness, a lower working portion 18 having the largest thickness and the inclined face portion 3 integrally formed at its upper and lower ends with the upper working portion 17 and lower working portion 18 respectively to bridge them. Thus, the distance between inner faces of radially opposed mold member 4 and 4 is designed to be reduced toward the lower working portions 18 and is the largest at the upper working portions 17. The distance Du between the inner faces 17A and 17A of the upper working portions 17 and 17 of radially opposed mold members 4 and 4 is, as shown in FIG. 3B, designed to be slightly larger than the outer diameter Dx of the drum X to be compressed and the distance D1 of the inner faces or lower working faces 18A and 18A of the lower working portion 18 and 18 thereof is, as shown in FIG. 5C, set to be slightly smaller than the inner diameter Dc of a new container such as a drum C. The inclined face 3A of each inclined face portion 3 has an arcuate section convex outwards and is in contact with an imaginary conical face F tapering downwards toward the axis thereof or the axis Z of the punch member 10 as shown by the dot-and-dash line in FIG. 3A. The inclined angle A of the inclined face 3A formed with a vertical line or the axis Z is set to introduce the drum smoothly from the upper working face 17A to the lower working face 18A in view of the friction between drum X and the inclined face 3A. In this embodiment, the inclined angle A is about 12°. Thus, the cavity wall W of the mold 3 includes a cylindrical cavity R1 at the upper working portion 17, a radial compression cavity R2 at the inclined face portions 3 and an axial compression cavity R3 at the lower working portions 18 of the mold 2.

The bottom mold plate 6 sustains compressive force exerted from the compacting mechanism 1 during compacting the drum X. When the drum X is reduced to a predetermined volume, the bottom mold plate 6 is forced by a hydraulic cylinder 23, to slide horizontally on the base 7 for discharging the volume reduced drum Y from the lower opening of the mold 2 onto the base 7.

In operation, the compression cylinder 8 is actuated to retract the rod 9 for locating the punch member 10 at an uppermost position 24 shown by the dot-and-dash line in FIG. 1. Then, an drum X having a diameter Dx is charged into the mold 2 as shown by another dot-and-dash line. In this state, the drum X is supported at its bottom on upper portions of the inclined faces 3A of each inclined face portion 3 without subjecting to any deformation. (FIG. 5A)

Subsequently, the compression cylinder 8 is reactuated to project the rod 9 for lowering the punch member 10, so that the drum X is compressed by the punch member 10 in the direction of the axis Z. As illustrated in FIG. 5B, during this compression, contact portions 22A of the circumferential wall 22 of the drum X, which are in contact with the inclined faces 3A, are subjected to large radial compressive forces from the inclined faces 3A due to wedge effect of the latter, so that the diameter of the drum X is gradually reduced at the contact portions 22A of the X.

FIG. 5B illustrate the drum X during compression in the upper portions of the inclined faces 3A. In this state, the drum X is at a relatively low density. The contact portions 22A of the circumferential wall 22 of the drum X are hence easily plastically deformed radially inwards by the inclined faces 3A of the mold member 4 while the other portions 22B of the circumferential wall 22 which bridge between inclined faces 3A of two adjacent mold members 4 and 4 are in a tensile state, with the result that the diameter of the drum X is reduced alto at the other portions other 22B. This phenomenon easily occurs in a container, with a circumferential wall of an appropriate mechanical strength, such as a steel drum containing a solid waste in this embodiment.

Although there is a possibility that the circumferential wall 22 protrudes radially outwards into the receiving recesses 5, this protrusion phenomenon is suppressed by both the radially inward compression of the contact portions 22A of the drum X by the inclined faces 3A of the mold members 4 and the tensioning of the other portions 22B toward the contact portions 22A while the drum X is at a relatively low density.

In the final stage of the radial compression operation, the compressed contact portions 22A of the drum X reached to the lower portions of the inclined faces 3A of the mold members 4, in which event the inclined faces 3A fairly project radially inwards into the circumferential wall 22 of the drum X, so that the circumferential wall 22 is formed into a spur-gear like shape with vertical or axial grooves 22C. In this state, in the vicinity of the lower portions of the inclined faces 3A, the contact portions 22A of the compressed drum X have an outer diameter substantially equal to the distance D1 between the lower working faces 18A and 18A of the lower working portion 18 and 18 of the opposed molding members 4 and 4. On the other hand, the outer diameter Da of other portions 22B becomes slightly larger than the distance D1. This is because when the drum X becomes fairly dense, the other portions 22B undergoes plastic deformation radially outwards due to axially outward force Fro caused by radial expansion of the drum X, the axially outward force Fro being larger than axially inward force Fri due to tensioning of the other portions 22B.

When the drum X is further depressed and reaches to the bottom mold plate 6, it is subjected to axial or vertical compression by the punch member 10, thus reducing it height to form into a finished compressed drum Y shown by the dot-and-dash line in FIG. 1. Then, the bottom mold plate 6 is slid by actuating a hydraulic cylinder 26 to open the lower end of the mold 2, from which end the compressed drum Y is discharged by further lowering the punch member 10. Thereafter, the bottom mold plate 6 is returned to the original position to close the lower end of the mold 2, so that the compressed drum Y is pushed by the front end 6A of the bottom mold plate 6 to be located outside the apparatus. Simultaneously, the rod 9 is retracted to locate the punch member 10 at the upper limit position 24 in FIG. 1. Then, the finished, compressed drum Y is subjected to a final treatment such as placement of it into a new drum C.

Referring to FIGS. 6 to 15, there is illustrated another embodiment of the present invention, which generally includes a punch unit 30, a base 32, a mold 34 placed on the base 32, a drum supplying mechanism 36 for supplying a drum X to be compressed to the mold 34, a punch separation mechanism 38 for separating the mold 34 from the base 32 and a compressed drum discharging mechanism 40 for discharging a compressed drum Y from the mold 34.

As shown in FIGS. 6 to 9, two vertical guide rods 42 are erected on a base 32 and are jointed at their upper portions with an upper frame 44. The two vertical guide rods 42 have an elevating main frame 46 slidably fitted around them for vertical movement. A pair of hydraulic compression cylinders 48 are mounted on the upper frame 44 for elevating the elevating main frame 46. The elevating main frame 46 has a cylindrical rod 50 mounted to its lower face to extend downwards coaxially with a vertical axis Z. The cylindrical rod 50 has the punch unit 30 provided to its lower end.

Figure 13:
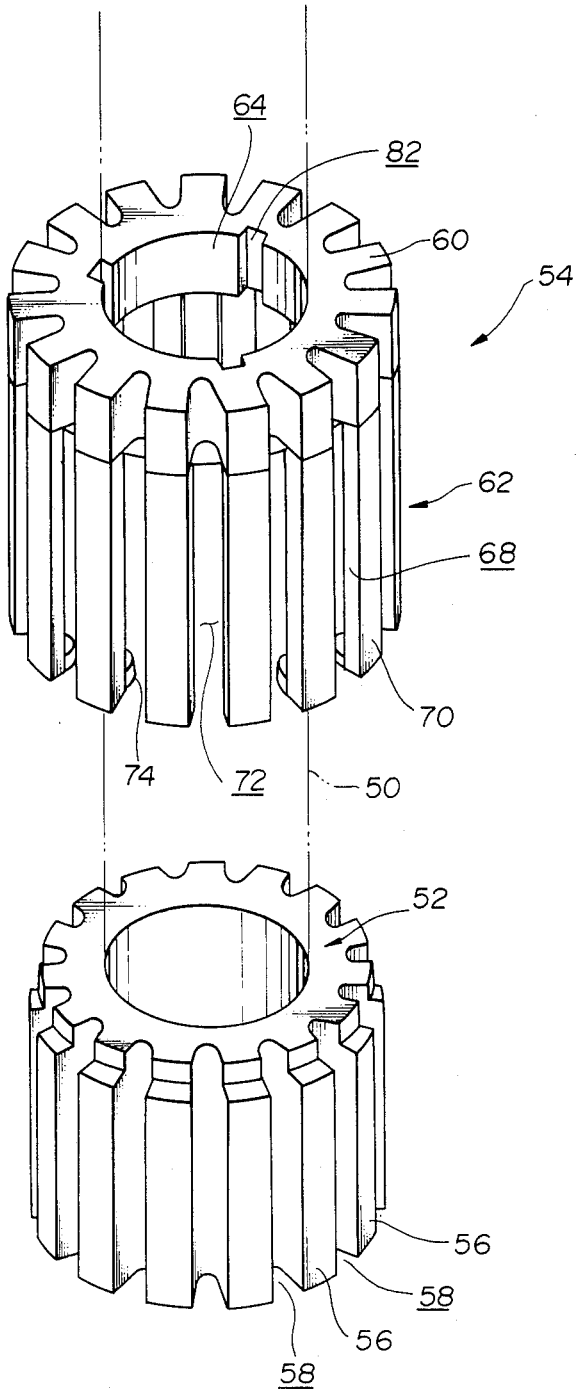
FIG. 13 is an enlarged perspective view of the smaller and larger diameter punches in FIG. 12, in which the cylindrical rod is illustrated by the dot-and-dash line.

The punch unit 30, as clearly shown in FIGS. 9 and 13, includes a smaller diameter punch 52 and a larger diameter punch 54 detachably attached to the smaller diameter punch 52. More specifically, the smaller diameter punch 52 is concentrically mounted to the lower end of the cylindrical rod 50. The smaller diameter punch 52 has a spur-gear like shape having fifteen teeth 56 axially formed in the circumferential face at regular angular intervals about the axis Z. Two adjacent teeth 56 and 56 define an axial groove 58 between them. The larger diameter punch 54 has a ring portion 60 and a skirt portion 62 axially depending from the outer periphery of the ring portion 60. The ring portion 60 has a central through hole 64 for passing the cylindrical rod 50. The skirt portion 62 includes fifteen axial through slots 68 axially formed through it at regular angular intervals about the axis thereof, thus having fifteen tooth portions 70 defined by adjacent axial through slots 68. The interior 72 of the skirt portion 62 constitutes a smaller diameter punch receiving recess. Each of the tooth portions 70 is bent at its distal end radially inwards to form a connecting finger 74 for transmitting a compressive force from the smaller diameter punch 52 to the larger diameter punch 54 when compression is carried out in combination of the smaller diameter punch 52 with the larger diameter punch 54.

Figure 10A:
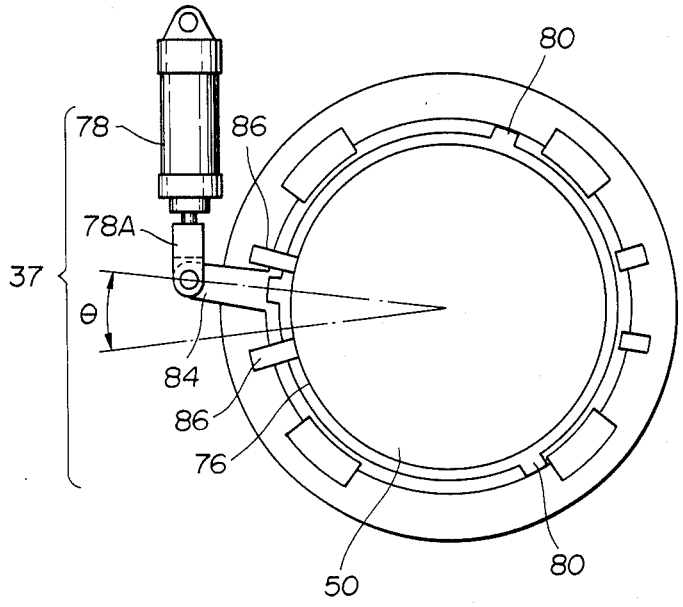
FIG. 10A is an enlarged plan view of the punch separation mechanism in FIG. 7.
Figure 11:
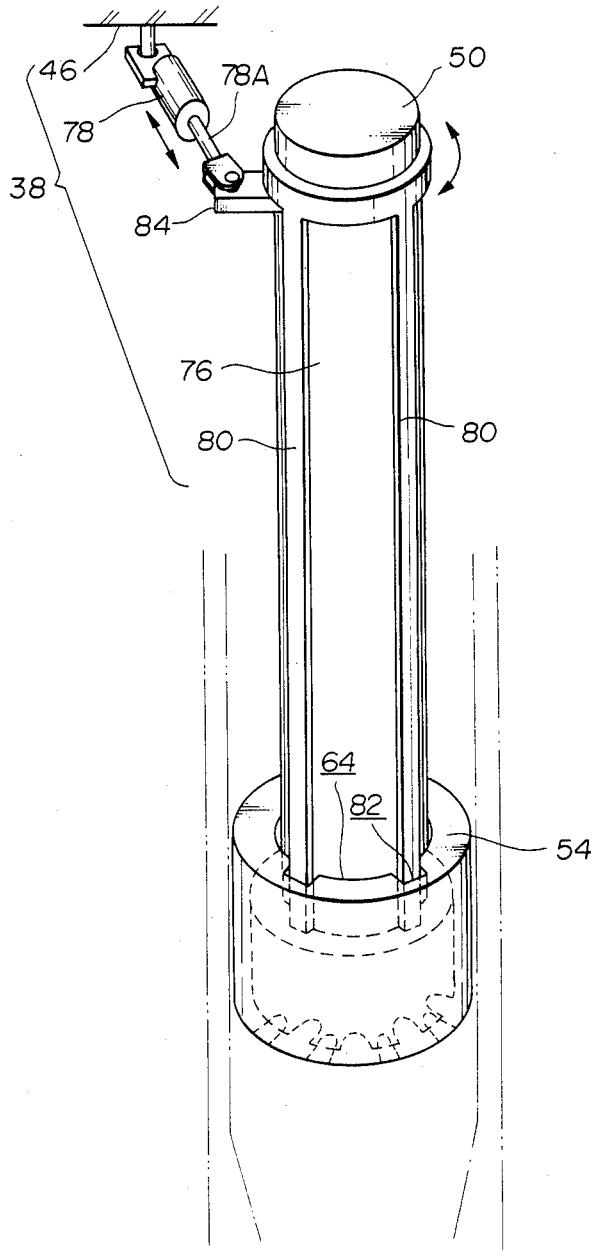
FIG. 11 is an enlarged perspective view of the punch separation mechanism and the punch unit in FIG. 6, in which the finger portions of the larger diameter punch is in engagement with the smaller diameter punch.
Figure 12:
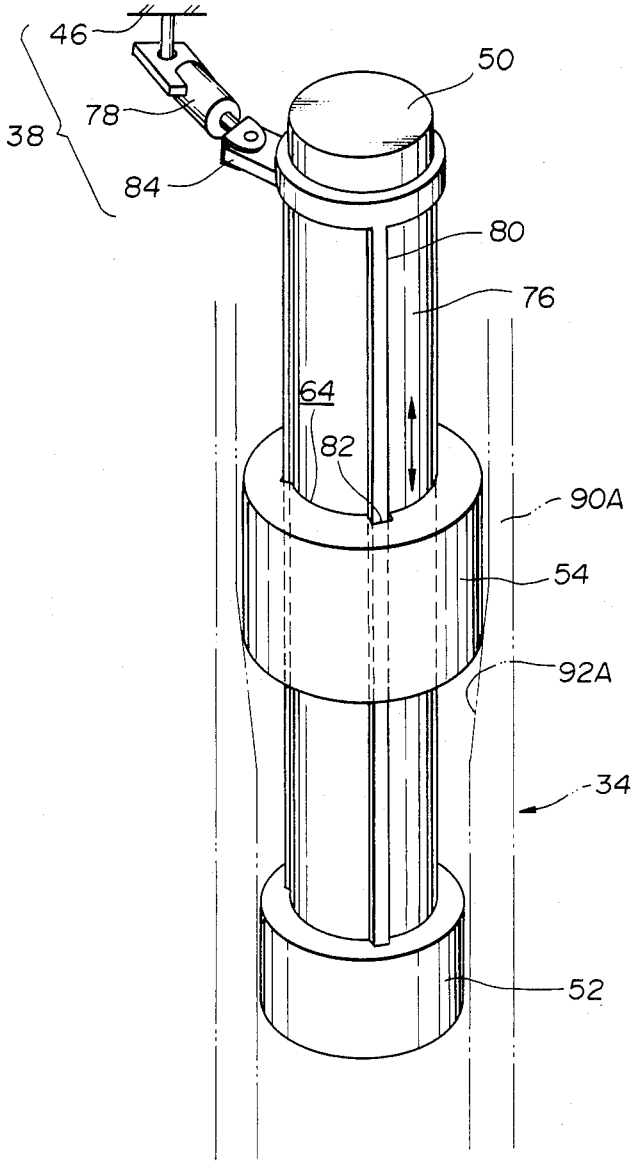
FIG. 12 is an enlarged perspective view of the punch separation mechanism and the punch unit in FIG. 6, in which the smaller diameter punch is separated from the larger diameter punch.

The punch unit separation mechanism 37, which is connected to the punch unit 30 for assembling and disassembling the latter, is clearly illustrated in FIGS. 10A, 11 and 12. The punch unit separation mechanism 37 includes a sleeve 76, fitted around the cylindrical rod 50, and an hydraulic drive cylinder 78 connected to the sleeve 76 for turning the latter within an angle $\theta$, for example, 12° about the axis Z. The sleeve 76 has three keys 80 integrally and axially formed at its outer face at regular angular intervals, the keys 80 engaging corresponding key seats 82 formed in the wall of the central through hole 64 for slidably passing the sleeve 76 through central through hole 64. The hydraulic drive cylinder 78 is pivotably connected to the lower portion of the elevating main frame 46 and its rod 78A is also pivotably connected at its distal end to a lever 84 for turning the sleeve 76 about the axis Z, the lever 84 being integrally formed with the upper end of the sleeve 76. A pair of stoppers 86 and 86 are mounted to the cylindrical rod 50 for restricting the angle of movement of the sleeve 76 within the angular range of 12°.

Figure 9A:
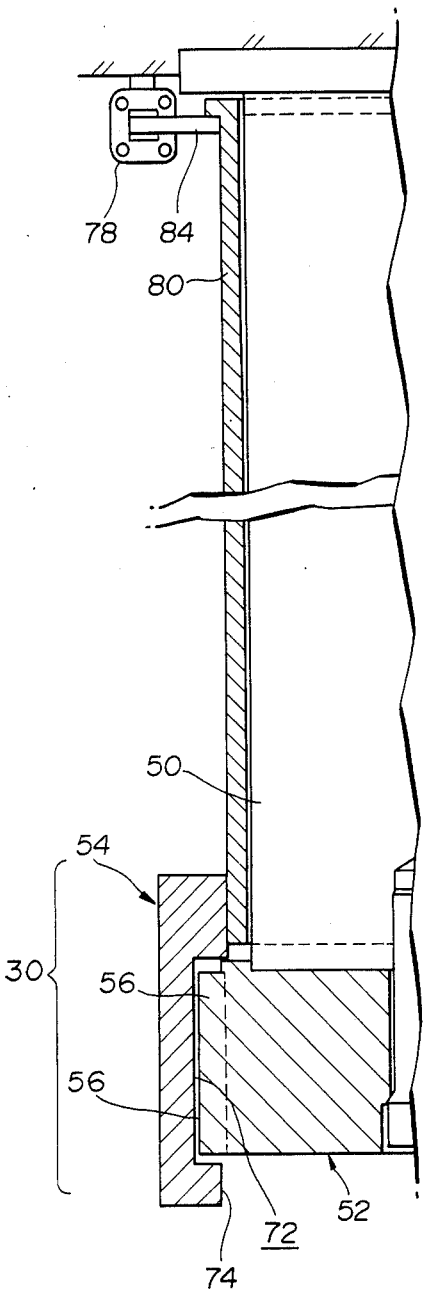
FIG. 9A is an enlarged axial cross-section of one half of the punch unit in FIG. 6, in which the smaller diameter punch and the finger portions of the larger diameter punch are in engagement with each other.
Figure 9B:
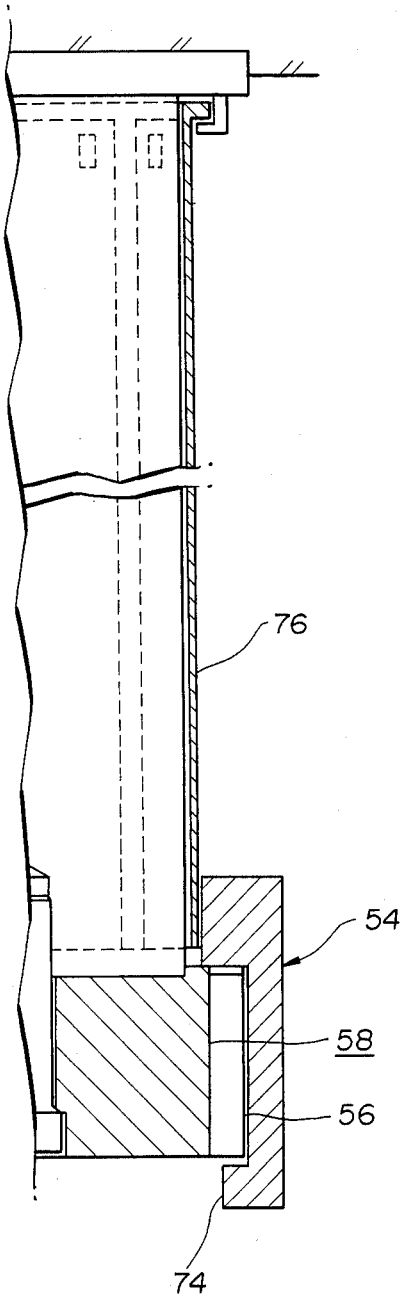
FIG. 9B is an enlarged axial cross-section of the other half of the punch unit in FIG. 6, in which the smaller and the finger portions of larger diameter punch are out of engagement with each other.

By moving the lever 84 with the hydraulic drive cylinder 78, the larger diameter punch 54 is selectively set to an engaged state shown in FIGS. 9A and 11 or a disengaged state in FIG. 9B. In the engaged position, the smaller diameter punch 52 is received within the interior 72 of the larger diameter punch 52 and teeth 56 thereof are registered to respective tooth portions 70. Thus, the upper and lower ends of the teeth 56 are restrained by the lower face of the ring portion 60 and connecting fingers 74 respectively, so that axial or vertical movements of the larger diameter punch 54 relative to the smaller diameter punch 52 are prevented in this engaged state, in which initial compression, which will be described hereinafter, is carried out. In the disengaged state, the connecting fingers 74 of the larger diameter punch 54 are registered to respective axial grooves 58 and is disengaged from the teeth 56. Thus, the smaller diameter punch 52 and the larger diameter punch 54 are axially movable to each other by passing the connecting fingers 74 through respective axial grooves 58. In this state, although downward movement of the larger diameter punch 54 is restrained by the smaller diameter punch 52, it is freely movable upwards relative to the smaller diameter punch 52, so that the larger diameter punch 54 may be separated from the smaller diameter punch 52 and thus, the smaller diameter punch 52 may be, as illustrated in FIG. 12, lowered by sliding the sleeve 76 down through the larger diameter punch 54 for high compression described hereinafter.

As clearly illustrated in FIGS. 14, 15 and 17A–C, the mold 34 includes: a hollow cylindrical body 90; fifteen first trapezoidal mold member 92 mounted at its longer edge to the inner face 91 of the hollow cylindrical body 90 at regular angular intervals about the axis thereof or the axis Z; and fifteen second trapezoidal mold members 94 mounted at its longer edge to the inner face 91 to be sandwiched between two adjacent first mold members 92 and 92 without any clearance. The radial thickness Tr2 of the second mold member 94 is smaller than the radial thickness Tr1 of the first mold member 92.

The first mold members 92 are arranged in the shape of inner teeth and adapted to engage both the teeth 56 of the smaller diameter punch 52 and the tooth portions 70 of the larger diameter punch 54 with small clearances. Each of the first mold members 92 and the second mold member 94 also has inclined faces 92A and 94A and straight axial edges 92B and 94B, respectively.

The second mold members 94 occupy parts of lower portions of axial grooves 96 defined between adjacent first mold members 92 and 92.

The distance Dn between straight edges 94B and 94B of each pair of opposed second mold members 94 and 94 is designed to be smaller than the minimum inner diameter Dz of a new drum C in which a volume-reduced drum Y is to be contained. More specifically, the hollow cylindrical body 90, first mold members 92 and second mold members 94 are limited in radial size by the following equation:

$$Do > Dx > Dz > Dn > Dy > Da$$

where Do is the inner diameter of the upper end of the hollow cylindrical body 90; Dx the maximum outer diameter of the drum X before compression; Dy the maximum outer diameter of the compressed drum Y; and Da the distance between straight edges 92B and 92B of each pair of opposed first mold members 92 and 92.

Figure 14:
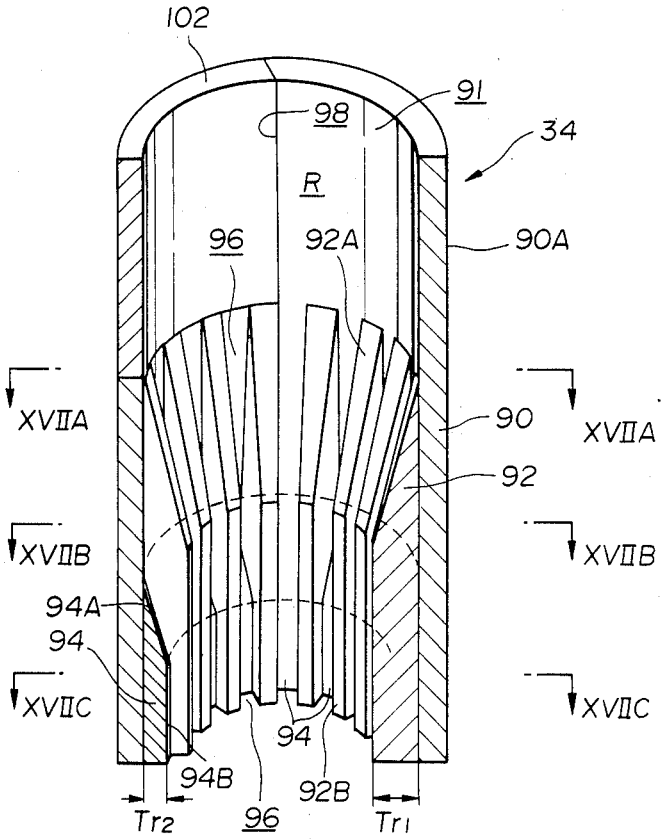
FIG. 14 is an enlarged perspective view, in axial section, of the mold in FIG. 6.
Figure 15:
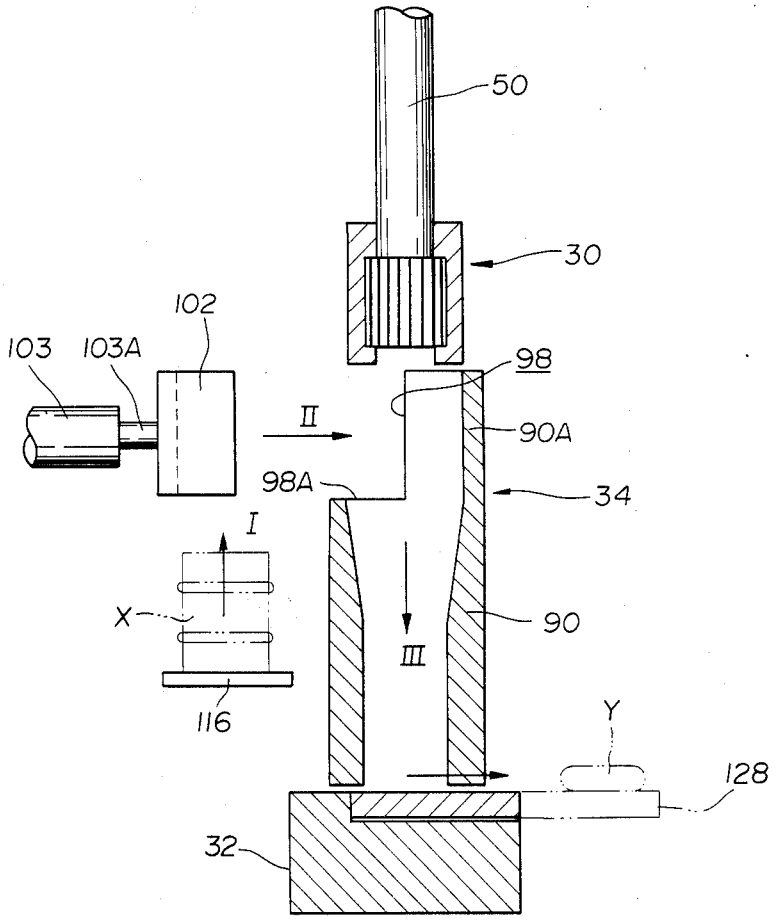
FIG. 15 is a diagrammatic illustration of the volume-reduction apparatus in FIG. 6.

The hollow cylindrical body 90 has, as illustrated in FIGS. 14 and 15, an upper working portion 90A partly cut off to form a semi-cylindrical charging opening 98. The semi-cylindrical cut-off portion constitutes a closure member 102, which closes the charging opening 98 to define a cylindrical cavity R within the upper working portion 90A. The closure member 102 is mounted at its outer face to a rod 103A of a pushing hydraulic cylinder 103 fixed to a frame (not shown).

Figure 6:
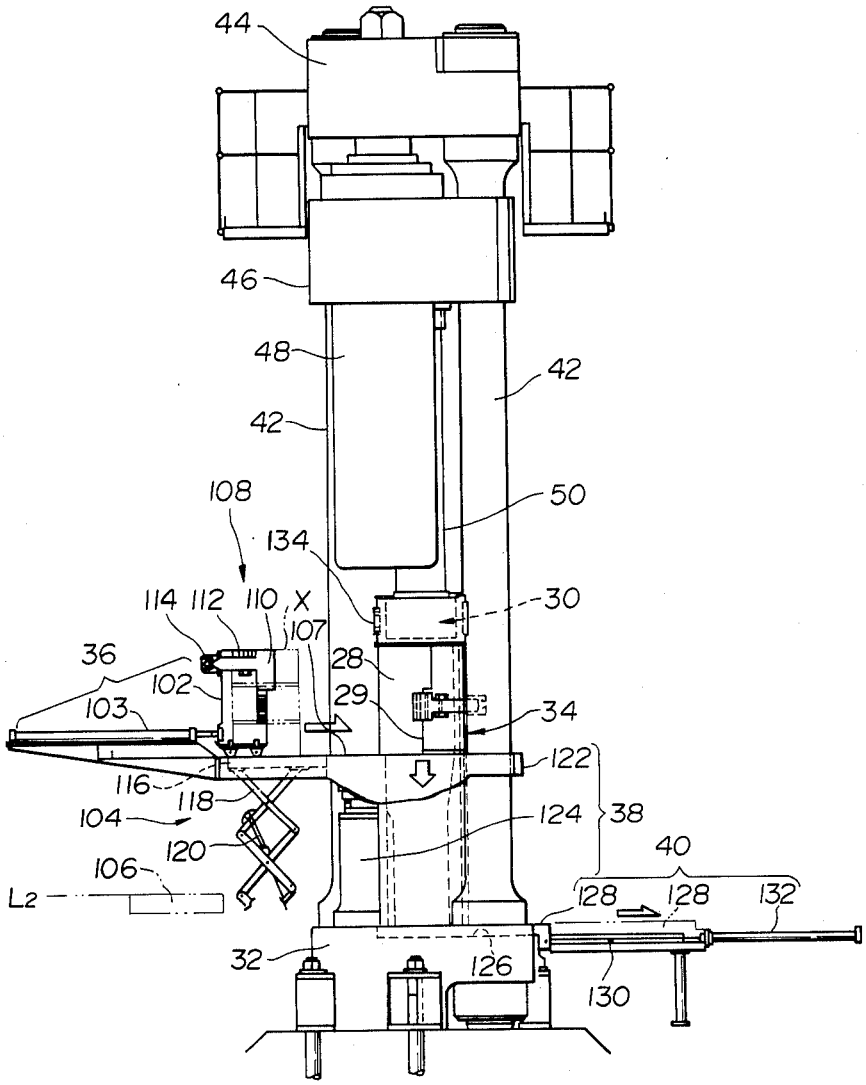
FIG. 6 is a front view of another embodiment of the present invention.
Figure 7:
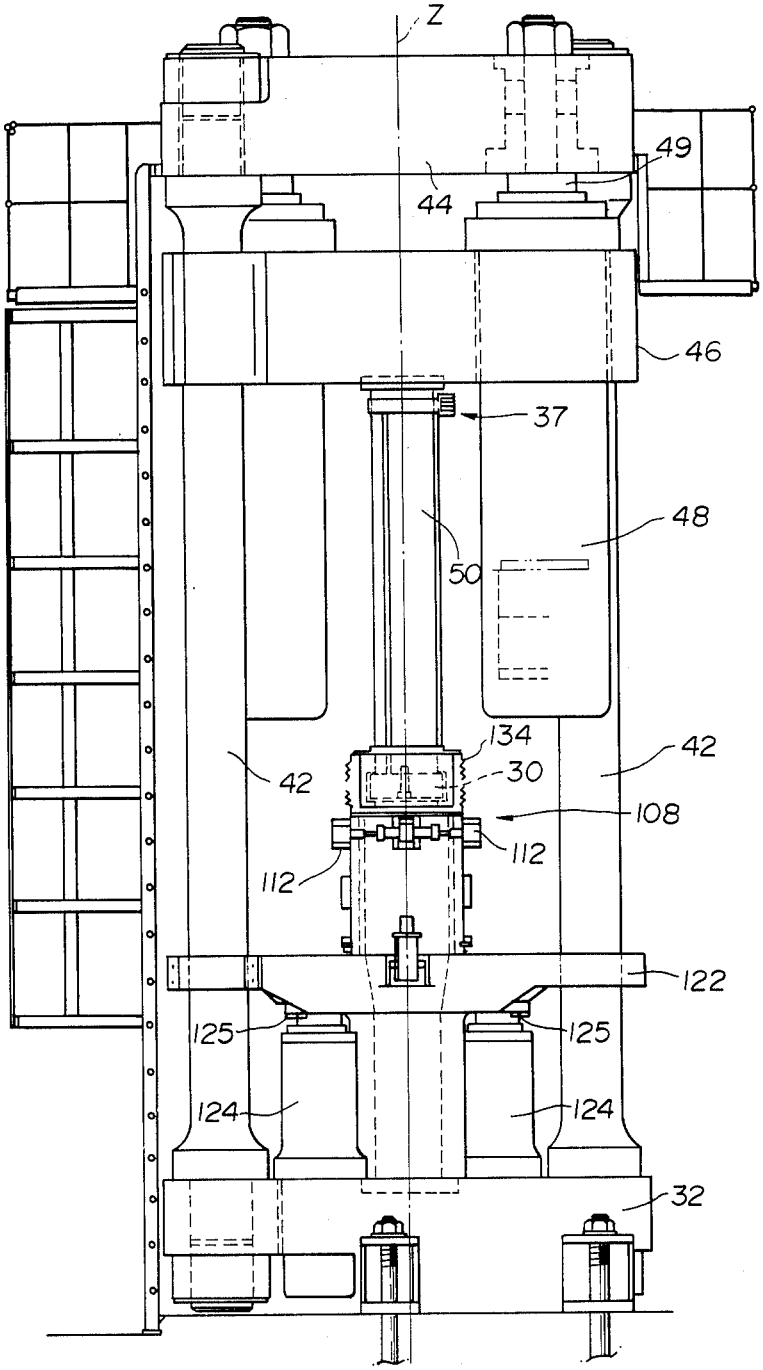
FIG. 7 is a side view of the volume-reducing apparatus in FIG. 6 as viewed from the left side thereof.
Figure 8:
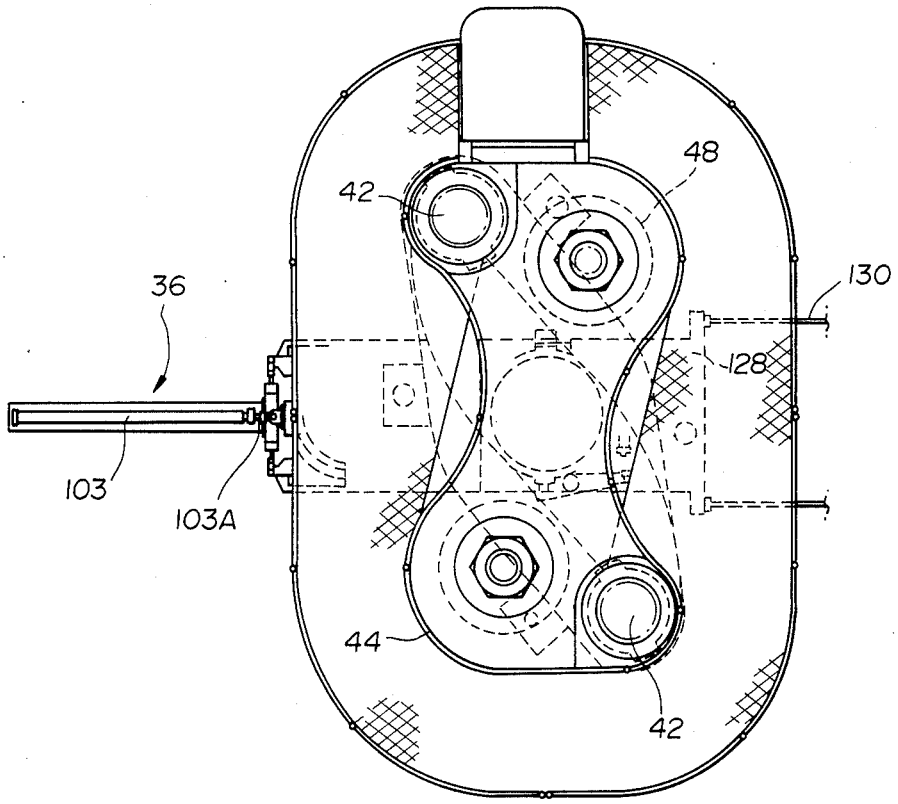
FIG. 8 is an enlarged plan view of the volume-reducing apparatus in FIG. 6.

The drum supplying mechanism 36 includes, as shown in FIGS. 6 and 7, a lifter 104 for lifting the drum X from a conveyor 106 at a level L2 to a position at a level L1 at which the charging opening 98 opens. The drum supplying mechanism 36 further includes a support plate 107 horizontally extending to the lower edge 98A (FIG. 15) of the charging opening 98 at the level L2 for sliding the drum X to the opening 98. The closure member 102 pushes the drum X at the level L1 towards the charging opening 98 by actuating the pushing cylinder 103.

The closure member 102 has a clamp mechanism 108 mounted to its outer face. The clamp mechanism 108 includes: a pair of clamping levers 110 and 110 for clamping the drum X by one ends thereof; a pair of supporting pins 112 and 112 each pivotably mounting corresponding clamping lever 110 to the closure member 102 for horizontally turning the levers about it; and a hydraulic cylinder 114 connected to the other ends of the clamping levers 110 and 110. When actuated, the cylinder 114 turns the clamping levers 110 and 110 to move their one ends toward each other for clamping the drum X against the inner face of the closure member 102.

The lifter 104 includes an elevating plate 116, a pantograph 118 for horizontally holding the elevating plate 116 and a hydraulic cylinder 120 to vertically expand and contract the pantograph 118 for lifting the drum X placed on the elevating plate 116 from the level L2 to the level L1.

The mold separating mechanism 38 includes a guide frame 122 slidably fitted around the two vertical guide rods 42 and 42. The guide frame 122 is mounted around the mold 34 just below the lower edge 98A of the charging opening 98. Between the guide frame 122 and the base 32 there are disposed a pair of hydraulic lift cylinders 124 and 124 for vertically moving the guide frame 122. The two hydraulic cylinders 124 and 124 are actuated when a compression end signal is generated after high compression by the smaller diameter punch 52.

The discharging mechanism 40 is actuated according to a mold separation end signal which is generated when mold separation is carried out by the mold separation mechanism 38. The base 32 has a slide groove 126 formed in its upper face to open to its one side remote from the conveyor 106. A slide bottom mold plate 128 is slidably fitted in the slide groove 126. The slide bottom mold plate 128 is jointed to rods 130 and 130 of a pair of discharging hydraulic cylinders 132 and 132, mounted to the frame not shown, for horizontal movement. A conventional transferring mechanism, such as a chain block, may be provided above the discharging mechanism 40 for transferring the compressed drum Y to a destination.

In FIGS. 6 and 7, the reference numeral 134 designates a dust cover covering the upper portion of the mold 34 and the lower end portion of the cylindrical rod 50. The dust cover 134 is communicated to a suction pump (not shown) through a high efficiency particulate air (HEPA) filter.

The operations of the compression apparatus will be now described. FIG. 15 is a diagrammatic illustration of steps for reducing the volume of the drum X, which moves in the directions shown by the arrows. FIGS. 16A to 16K demonstrate how to compress the drum X in the mold 34.

Before introducing the drum X into the mold 34, the rods of the compression cylinder 48 and 48 are retracted to place the punch unit 30 at the upper limit position above the mold 34 as shown by the broken line in FIGS. 6 and 7 while the rods of the lifting cylinders 124 and 124 are retracted to locate the guide frame 122 at the lower limit position shown by the solid line where the lower end of the mold 34 is in contact with the slide bottom mold plate 128. Simultaneously, the rod 103A (FIG. 8) of the pushing cylinder 103 is retracted to locate the closure member 102 at the waiting position shown by the solid line in FIG. 6. The smaller diameter punch 52 and the larger diameter punch 54 are placed in the engaged state as shown in FIGS. 9 and 11 so that they are vertically movable together. In this state, the larger diameter punch 54 depends from the smaller diameter punch 52.

The drum X is transported by the conveyor 106 to a position adjacent to the lifter 104 and is then placed on the elevating plate 116 with its axis parallel to the axis Z. After the closure member 102 is placed at the waiting position (FIG. 6), the cylinder 120 are actuated to lift the drum X from the level L2 to the level L1 as indicated by the arrow I in FIG. 15.

Then, the actuator 114 is actuated to hold the drum X, which has been placed close to the inner face of the closure member 102, against that inner face by the clamping levers 110, thus keeping the drum X in the standing position as shown in FIG. 6. Thereafter, the pushing cylinder 103 is actuated to slide the drum X on the support plate 107 toward the mold 34 in the direction II in FIG. 15. In the vicinity of the mold 34, the cylinder 114 is deactivated to release the drum X, and then the drum X is pushed into the cavity R of the upper working portion 90A of the mold 34 through the charging opening 98, so that it drops into the cavity R and, as shown in 16A, stopped by the inclined faces 92A of the first mold members 92 with little deformation thereof. In this case, the drum X is small in drop as compared to the drum X in the preceding embodiment which is dropped from the upper opening of the mold 34. Thus, the drum X is, in this embodiment, subjected to less compact, so that it is likely to produce or scatter fragments or dust in a less amount than the drum X in the preceding embodiment.

After releasing the drum X, the distance between the clamping ends of the two clamping levers 110 and 110 are further widened by the cylinder 114 so that the one ends are located outside the charging opening 98. Then, the closure member 102 is further moved by the pushing cylinder 103 toward the mold 34 for closing the charging opening 98, so that the cylindrical cavity R is formed for subsequent volume reduction operations.

Just before the charging opening 98 is completely closed with the closure member 102, both the upper portion of the mold 34 and the lower end portion of the cylindrical rod 50 are covered with the dust cover 134 for preventing dust from leaking outside of the mold, the dust being produced in the dropping of the drum X into the mold 34 and during the subsequent compression operations.

Figures 16A, 16B, 16C, 16D, 16E:
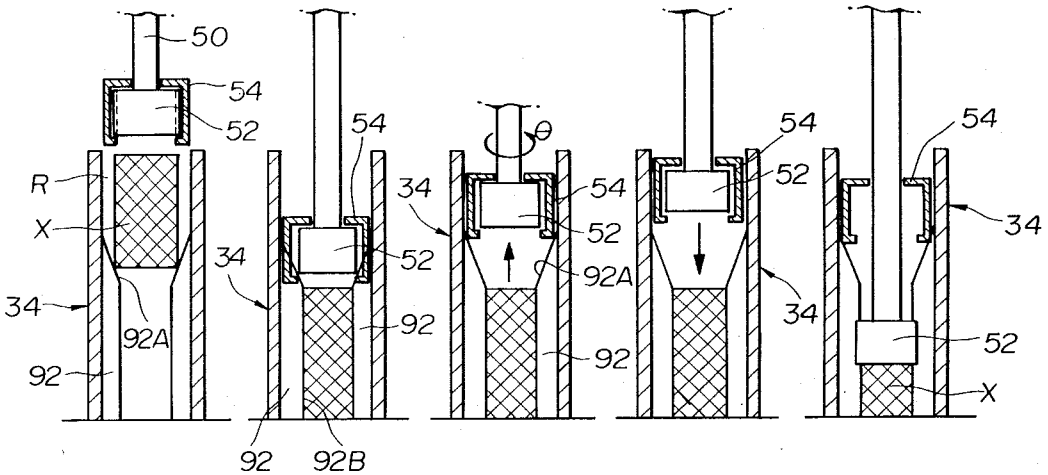
FIGS. 16A to 16K are diagrammatic illustrations of the mold, the smaller and larger diameter punches in respective steps in volume reduction of a container.

While the charging opening 98 is closed with the closure member 102 by actuating the pushing cylinder 103 to keep the cavity R, the compression cylinders 48 and 48 are actuated to lower the elevating main frame 46, so that the cylindrical rod 50 is moved downwards or in the direction III in FIG. 15 together with the punch unit 30 for performing an initial axial compression to the drum X with the punch unit 30, mainly with the larger diameter punch 54. Thus, the initial compression step as illustrated from FIG. 16A to FIG. 16B is carried out at a pressure less than about 1000 kg/cm$^2$. During this axial compression, the smaller and larger diameter punches 52 and 54 descend in the engaged state in FIG. 9A and compressive force from the cylindrical rod 50 is transmitted through the teeth 56 of the smaller diameter punch 52 to respective connecting fingers 74 of the larger diameter punch 54. Thus, the top face of the drum X is depressed at its central portion with the lower end of the smaller diameter punch 52 and at its peripheral portion with the lower end of the larger diameter punch 54.

Figure 10B:
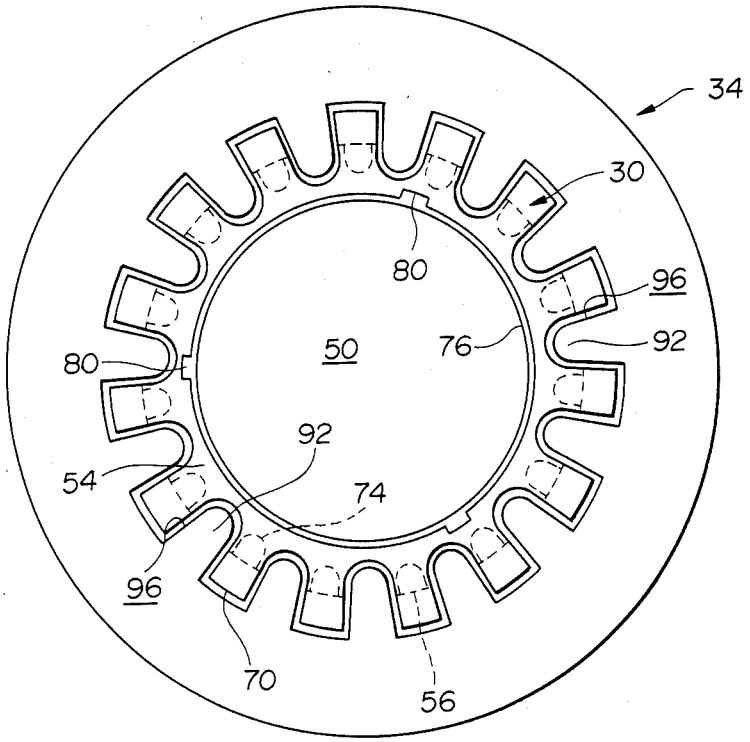
FIG. 10B is an enlarged plan view, partly in section, showing engagement of the punch unit with the mold in FIG. 6 for initial compression.
Figure 10C:
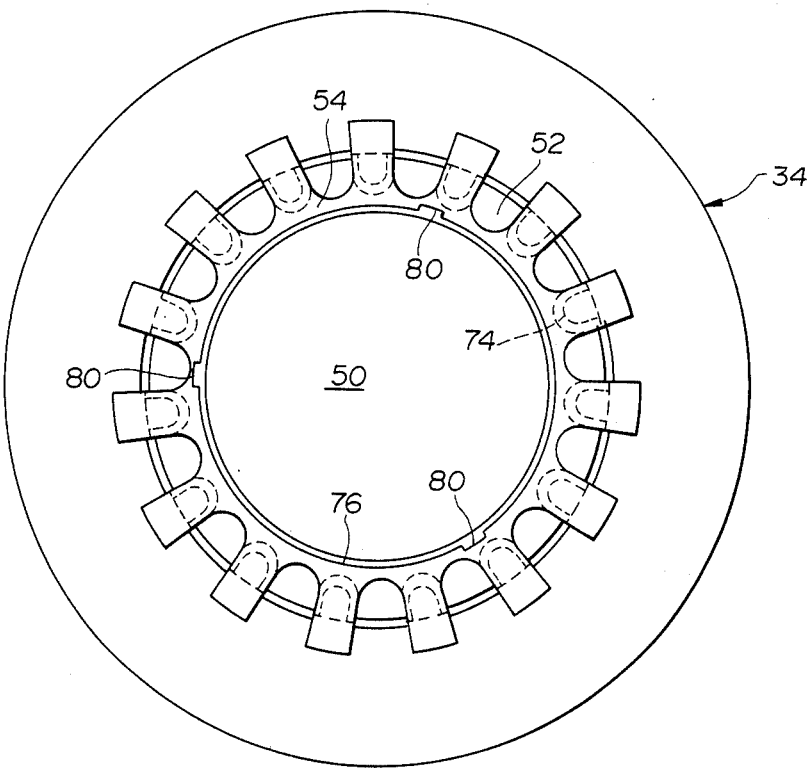
FIG. 10C is an enlarged plan view, partly in section, showing engagement of the punch unit with the mold in FIG. 6 for high compression.

FIG. 10B illustrates a plan view of the mold 34 and the punch unit 30 during the initial compression, in which the tooth portions 70 of the larger diameter punch 54 together with the teeth 56 of the smaller diameter punch 52 are lowered within respective axial grooves 96 formed between adjacent first mold members 92 and 92. In this initial compression, the drum X is also subjected to radial compression from the inclined faces 92A of the first mold members 92 as in the preceding embodiment, thus having a cross-section in FIG. 17B.

If the drum X is further depressed to come into contact with the straight edges 92B of the first mold members 92, the portions thereof bridging adjacent two straight edges 92B and 92B will begin to considerably protrude into the axial grooves 96. For preventing this phenomenon, the punch unit 30 is stopped at the position in FIG. 16B. For stopping the punch unit 30 at this position, a conventional position detector may be mounted to the cylindrical rods 50 to be activated at this position or a conventional pressure sensor may be provided for detecting a pressure rise in the compression cylinders 48 and 48.

Then, the punch unit 30 is lifted to a waiting position at the upper working portion 90A of the mold 34 as shown in FIG. 16C by retracting the rods 49 of the compression cylinders 48. In this event, the larger diameter punch 54 is lifted together with the smaller diameter punch 52 since the upper end of the smaller diameter punch 52 is in engagement with the ring portion of the larger diameter punch 54.

When the punch unit 30 is at the waiting position, the the turning cylinder 78 of the punch separation mechanism 37 is actuated to turn the sleeve 76 the angle $\theta$ as shown in FIG. 10A, thus turning with both the keys 80 and the key seats 82 the larger diameter punch 52 about the axis Z to register its connecting fingers 74 to respective axial grooves 58 of the smaller diameter punch 52 as illustrated in FIG. 11C. In the position in FIG. 9B, the larger diameter punch 54 is supported at its connecting fingers 74 on the inclined faces 92A of the first molding members 92. For more positively holding the larger diameter punch 54 to this waiting position, an appropriate locking mechanism such as an electromagnet may be mounted to the upper working portion 90A of the mold 34. Thus, connecting fingers 74 may pass axial grooves 58 and hence the sleeve 76 is, as illustrated in FIG. 12, axially movable relative to the larger diameter punch 54.

Figures 16F, 16G, 16H, 16I, 16J, 16K:
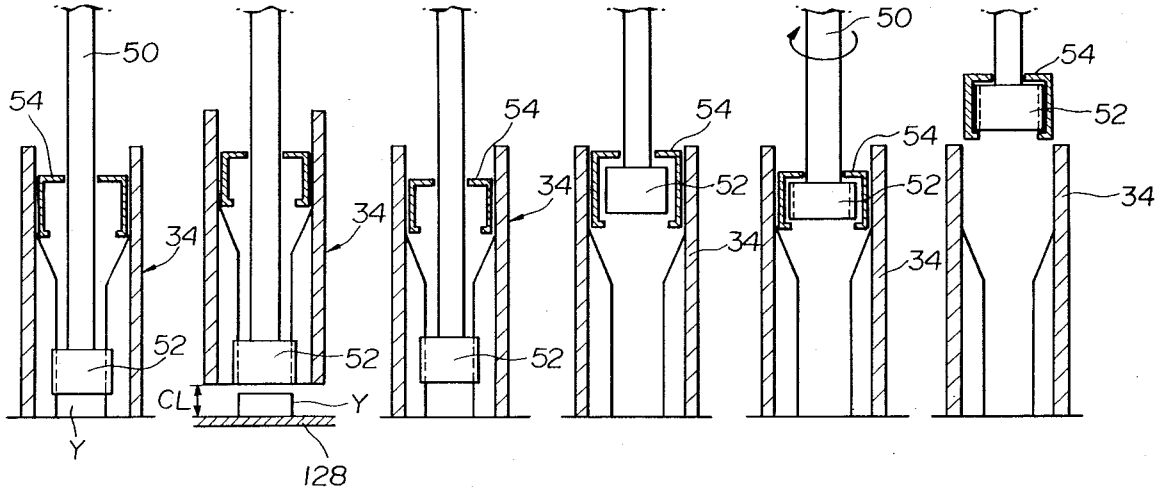
Figure 17A:
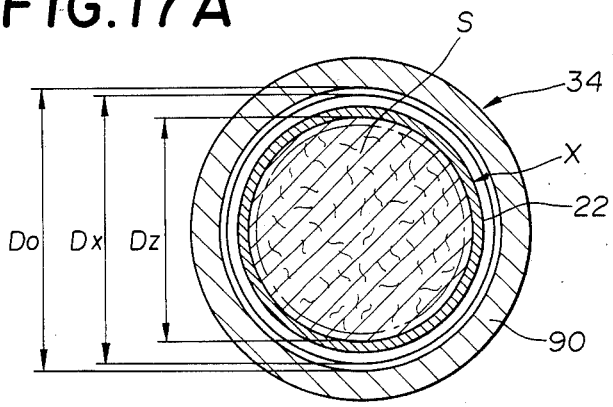
FIGS. 17A to 17C are cross-sectional views, in reduced scale, taken along the lines XVIIA—XVIIA, XVIIB—XVIIB and XVIIC—XVIIC in FIG. 14.
Figure 17B:
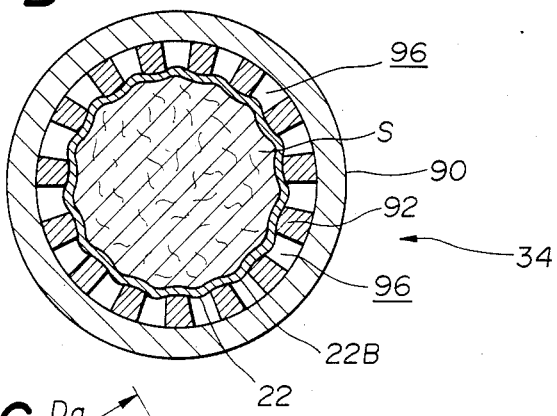
Figure 17C:
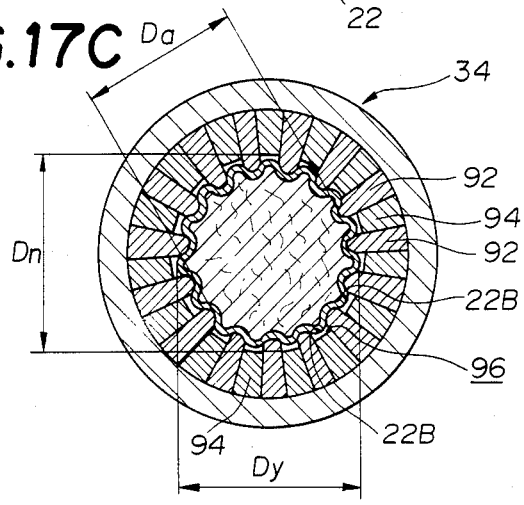

Then, the compression cylinder 48 are reactuated to project their rods 49, so that the cylindrical rod 50 is moved downwards for lowering the smaller diameter punch 52 in the arrow direction in FIG. 16D to compress the drum X at a high pressure, in this embodiment, about 1000 $Kg/cm^2$. In this high compression step, the drum X is mainly axially compressed to reduce its height as shown in FIG. 16E. On the other hand, portions 22B, bridging between two adjacent first mold members 92 and 92, of the circumferential wall 22 of the drum X further protrude into corresponding axial grooves 96, with the result that the drum X is formed into a finished, compressed drum Y in a spur-gear like shape with a higher density than the drum X in the initial compression step (FIG. 16F). The maximum outer diameter Dy of the compressed drum Y is limited within the distance Dn between straight edges 94B and 94B of each pair of opposed second mold members 94 and 94. Thus, the maximum outer diameter Dy of the compressed drum Y is smaller than the inner diameter of a new drum X in which the compressed drum Y is to be contained.

Then, the compressed drum Y is separated from the mold 34. For performing this operation, the smaller diameter punch 52 is slightly moved upwards by retracting the rods of the compression cylinders 42 and 42 for releasing the compressed drum Y from the maximum load, but it is kept in contact with the compressed drum Y. While the smaller diameter punch 52 holds the compressed drum Y against the slide bottom mold plate 128 of the base 32 in such a way, the lifting cylinders 124 and 124 are actuated to lift the mold 34 together with the guide frame 122, so that the compressed drum Y is separated from the mold 34. With such operations, the amount of production of dust from the compressed drum Y is made a minimum. The mold separation operation ends when the mold 34 is raised to such a height that the clearance CL between the lower end of the mold 34 and the upper face of the slide bottom mold plate 128 is sufficient to horizontally slide the compressed drum Y (FIG. 16G). Then, the smaller diameter punch 52 is further raised as shown in FIG. 16G.

The end of the mold separation is detected by sensing the upper limit positions of the rods 125 and 125 of the lift cylinders 124 and 124 with a conventional position sensor (not shown), which provides a mold separation end signal to the control unit for actuating the hydraulic cylinders 132 and 132 of the compressed drum discharging mechanism 40. Thus, the rods 130 and 130 of the hydraulic cylinders 132 and 132 are retracted, so that the slide bottom mold plate 128 is projected from the bottom mold base 32 as shown by the dot-and-dash line in FIG. 6, with the result that the compressed drum Y, placed on the slide bottom mold plate 128, is discharged outside the mold 34 as diagrammatically illustrated by the dots-and-dash line in FIG. 15.

The compressed drum Y thus discharged is transported with a suitable means such as a conveyor to a destination according to its volume and its radiation doze, where it is stored or contained in a new drum. The new drum containing the compressed drum Y may be recompressed in the compression apparatus according to the present invention.

Then, the hydraulic cylinders 132 is reactuated to project their rods 130 for returning the slide bottom mold plate 128 to fit to the slide groove 126. After this operation, the lift cylinders 124 and 124 are reactuated to retract their rods 125 and 125, so that the mold 34 is placed on the slide bottom mold plate 128 (FIG. 16H).

Thereafter, the rods of the compression cylinders 48 are retracted to lift the smaller diameter punch 52 to a position, shown in FIG. 16I, where the smaller diameter punch 52 is received in the larger diameter punch 54 and comes into contact with the lower face of the ring portion 60 of the larger diameter punch 54, thus supporting the latter to depend from it.

Then, the turning cylinder 78 of the punch separation mechanism 38 is actuated to retract its rod 78A, so that the larger diameter punch 54 is rotated angle $\theta$ in a direction reverse to the direction in FIG. 16C. Thus, the larger diameter punch 54 is switched from the disengaging state shown in FIG. 9B to the original engaging state in FIG. 9A or FIG. 11. From this engaging state, the operations above described may be repeated for another drum X.

Although in this embodiment the compression apparatus is actuated partially automatically, but it may be made full automatic by adopting various detectors for detecting the position of the punch unit 30, the end of operation of each mechanism, etc.

The compressing cylinders 48 and 48, punch separation mechanism 37, drum supplying mechanism 36, lifter 104, conveyor 106, mold releasing mechanism 38 and compressed drum discharging mechanism 40 may be actuated in parallel or overlap processing mode without adverse mutual intervention.

What is claimed is:

1. A compression apparatus for reducing solid waste in volume, comprising:

a base;

axial compression means for axially compressing a columnar container containing the solid waste, the axial compression means including punching means having first teeth projecting radially outwards from an outer periphery thereof at equal angular intervals about an axis thereof, bottom mold means mounted on the base, and drive means for driving the punching means toward the bottom mold means for axial compression; and a mold adapted to be placed on the bottom mold means and having a cavity wall for concentrically receiving the container, the cavity wall located coaxially to the punching means and including a plurality of mold projections projecting radially inwards and extending axially at equal angular intervals about the axis, each mold projection including an inclined inner face in contact with a conical plane tapering toward both the axis and the bottom mold means, the inclined inner faces being substantially equi-spaced around the axis and the cavity wall defining at the inclined inner faces a radial compression cavity, adjacent mold projections defining axial grooves therebetween for receiving expanded portions of the container during compression, the teeth of the punching means being adapted to pass through respective axial grooves so that the punching means may pass through the radial compression cavity for compressing the container radially inwards.

2. A compression apparatus as recited in claim 1, wherein the mold has a bottom end adapted to contact the bottom mold means, wherein each mold projection comprises an axial straight edge intervened between the inclined face and the bottom end and formed to be continuous with the inclined face, the cavity wall defining an axial compression cavity at the axial straight edges, and wherein the punching means is adapted to engage the straight edges so that the punching means enters into the axial compression cavity for axially compressing the container.

3. A compression apparatus as recited in claim 2, wherein each mold projection comprises a molding member separate from and fastened to the the cavity wall.

4. A compression apparatus as recited in claim 3, further comprising slide means for sliding the bottom mold means on the base for opening the bottom end of the mold to discharge the compressed container from the mold.

5. A compression apparatus as recited in claim 2, wherein the punching means comprises: a smaller diameter punch member having second teeth projecting radially outwardly from an outer periphery thereof, second teeth of the smaller diameter punch member being designed to engage respective straight edges of the mold projections; a rod member coaxially fixed at a distal end thereof to the smaller diameter punch member; a larger diameter punch member having an outer diameter larger than the smaller diameter punch member and adapted to fit around the outer periphery of the smaller diameter punch member in an engaged state, the larger diameter punch member having the first teeth formed in an outer periphery thereof; and means for selectively placing the larger diameter punch member into and out of engagement with the smaller diameter punch member, and wherein the smaller diameter punch member and the larger diameter punch member are in engagement with each other when both compress the container in the radial compression cavity and are out of engagement with each other before the smaller diameter punch member enters into the axial compression cavity for axially compressing the container.

6. A compression apparatus as recited in claim 5, wherein: two adjacent second teeth of the smaller diameter punch member define first axial grooves; the larger diameter punch member comprises a ring portion adapted to slidably fit around the rod member, and a skirt portion integrally formed with the outer periphery of the ring portion to axially extend, the skirt portion having second axial grooves formed in an outer face thereof at equal angular intervals about the axis for defining the first teeth between two adjacent second axial grooves; each first tooth has at one end thereof a connecting finger bent radially inwards, the one end being remote from the ring portion; the connecting fingers are movable through respective second grooves of the smaller diameter punch member; the selectively placing means comprises rotation means for rotating the larger diameter member about the axis to selectively bring each finger into engagement and out of engagement with one end of a corresponding second tooth, the one end of the corresponding second tooth being remote from the rod member; and the smaller diameter punch member is brought out of engagement with the larger diameter punch member by axially moving the larger diameter punch member relative to the smaller diameter punch member when the connecting fingers are out of engagement with the one ends of corresponding second teeth.

7. A compression apparatus as recited in claim 6, wherein the ring portion has an inner peripheral edge defining a concentric through hole for passing the rod member therethrough, the inner peripheral edge having an axial key seat formed therein, wherein the rotation means comprises a bush slidably fitted around the rod member, the bush having an axial key formed in the outer face thereof, the axial key slidably engaging the key seat for rotating the larger diameter punch about the axis.

8. A compression apparatus as recited in claim 7, wherein the mold has a charging opening, formed through it above the radial compression cavity, for charging the container thereinto, and further comprising container charging means including a closure member for closing the charging opening and moving means for moving the closure means toward and away form the charging opening to push the container into the mold through the charging opening.

9. A compression apparatus as recited in claim 8, further comprising lifting means for lifting the mold to discharge the container, compressed in the axial compression cavity, from the mold on the bottom mold means.

10. A compression apparatus as recited in claim 9, further comprising discharging means, mounted to the base, for discharging the compressed container on the bottom mold means to the outside of the apparatus.

11. A compression apparatus as recited in claim 10, wherein the bottom mold means is a plate member, and wherein the discharging means comprises a hydraulic cylinder for moving the plate member in a radial direction of the mold between a working position just below the mold and a discharge position away from the working position.

* * * * *